US005989162A

United States Patent [19]

Daniels

[11] Patent Number: 5,989,162

[45] Date of Patent: Nov. 23, 1999

[54] PORTABLE EXERCISE DEVICE

[76] Inventor: Tyrone S. Daniels, 1360 S. Main St., Springboro, Ohio 45066

[21] Appl. No.: 09/074,804

[22] Filed: May 8, 1998

[51] Int. Cl.[6] ..... A63B 22/06

[52] U.S. Cl. ..... 482/62

[58] Field of Search ..... 482/57–63, 908; 211/17, 22; D21/191

[56] References Cited

U.S. PATENT DOCUMENTS

| | | | |
|---|---|---|---|
| 1,386,206 | 8/1921 | Samuelson | 482/62 |
| 1,820,372 | 8/1931 | Blomquist . | |
| 3,216,722 | 11/1965 | Odom | 272/73 |
| 3,640,525 | 2/1972 | Proctor | 272/79 |
| 4,257,588 | 3/1981 | Ketchman | 272/73 |
| 4,390,177 | 6/1983 | Biran et al. | 272/73 |
| 4,565,365 | 1/1986 | Barkhurst | 482/61 |
| 4,902,002 | 2/1990 | Huang | 272/73 |
| 5,158,519 | 10/1992 | Hughes | 482/118 |
| 5,178,589 | 1/1993 | Wilson et al. | 482/62 |
| 5,330,402 | 7/1994 | Johnson | 482/62 |
| 5,338,272 | 8/1994 | Sweeney, III | 482/57 |
| 5,342,262 | 8/1994 | Hansen | 482/62 |

FOREIGN PATENT DOCUMENTS 2146250 4/1985 United Kingdom .

*Primary Examiner*—Stephen R. Crow
*Attorney, Agent, or Firm*—Biebel & French

[57] ABSTRACT

An exercise device including a frame having an upper frame portion and a lower frame portion. The upper frame portion supports an arm exercise member for exercising the arms of a user, and the lower frame portion supports a leg exercise member for exercising the legs of the user. The device is provided with a mechanism for adjusting the height of the arm exercise member relative to the leg exercise member. In addition, the frame for the device includes a pivot joint whereby the device may be folded from a use configuration to a storage configuration which is approximately one-half the height of the use configuration.

19 Claims, 5 Drawing Sheets

80A
50
78
78
80A
76
54
52
70
74
12
82
82
84
84
56
58
48
64
46
64
44
10
42
14
22
30
80B
16
26
78
28
72
40
20
74
40
24
76
36
38
40
78
18
80B
32
34
40

PORTABLE EXERCISE DEVICE

BACKGROUND OF THE INVENTION

This invention relates generally to exercise devices and, more particularly, to an exercise device designed to exercise the arms and legs of a user, and which is capable of being reconfigured from a use to a storage position for easy portability and storage of the device.

Individual exercise devices, such as exercise bikes and related apparatus, have become very popular as a convenient means of exercise for individuals with limited mobility or where exercise space is limited. Prior art devices have provided means for exercising either the arms or legs, or both. For example, U.S. Pat. No. 5,330,402 discloses an exercising device including a seat for supporting a user, and including a pedal crank for exercising the user's legs and an arm crank for exercising the user's arms. While this device is effective for providing exercise to both the arms and legs of a user, it suffers from the disadvantage of being somewhat large and bulky and therefore difficult to transport or store conveniently.

U.S. Pat. No. 4,902,002 also discloses an exercise device including mechanisms for exercising both the arms and the legs, and wherein the arm exercising mechanism is adjustable in the vertical direction. This device is also rather bulky and therefore difficult to transport and store.

U.S. Pat. No. 4,390,177 discloses a foot operated exercising device including a frame for rotatably mounting foot pedals. The frame may be provided in two sections pivotally connected together by a hinge whereby the device may be folded for compact transportation and storage. While this device provides for convenient transportation or storage when not in use, there is no provision for exercising the arms of the user, and thus is not capable of providing as complete a workout as other devices incorporating both arm and leg exercising mechanisms.

Accordingly, there remains a need for an exercising device capable of exercising the user's arms and legs wherein the exercising device is sufficiently light to provide for convenient transportation, and is additionally collapsible to provide for convenient transportation and storage of the device.

SUMMARY OF THE INVENTION

The present invention provides an exercise device including a frame having an upper frame portion and a lower frame portion wherein the upper frame portion is pivotally mounted to the lower frame portion. The upper frame portion supports an arm exercise member for exercising a user's arms, and the lower frame portion supports a leg exercise member for exercising a user's legs. The arm and leg exercise members are formed as crank mechanisms, each including pedals for engagement with a user's hands and feet in a rotating pedaling motion.

The pivot connection between the upper frame portion and the lower frame portion permits the upper frame portion to be pivoted from a use position where the arm exercise member is located above the pivot connection to a storage position where the arm exercise member is located below the pivot connection and positioned adjacent to the leg exercise member. In the storage position, the height of the frame of the exercise device is approximately half of the height of the frame in the use position whereby the exercise device is positioned in a compact configuration for convenient transportation and storage.

The arm and leg exercise members are mounted for rotation independently of each other, and each exercise member includes a brake for selectively providing resistance to rotatable movement of the exercise members. The brake includes a rotating disc mounted for rotation with the exercise member and stationary friction members for frictionally engaging and resisting rotation of the disc.

Therefore, it is an object of the present invention to provide an exercise device which is capable of exercising a user's arms and legs and which is conveniently transported and stored.

It is a further object of the invention to provide such an exercise device including a frame having a pivot joint to permit the frame to be positioned in a compact configuration.

It is yet another object of the invention to provide an exercise device including arm and leg exercise members, each including a brake for selectively providing resistance to the exercise members.

Other objects and advantages of the invention will be apparent from the following description, the accompanying drawings and the appended claims.

DETAILED DESCRIPTION OF THE PREFERRED EMBODIMENT

Figure 1:
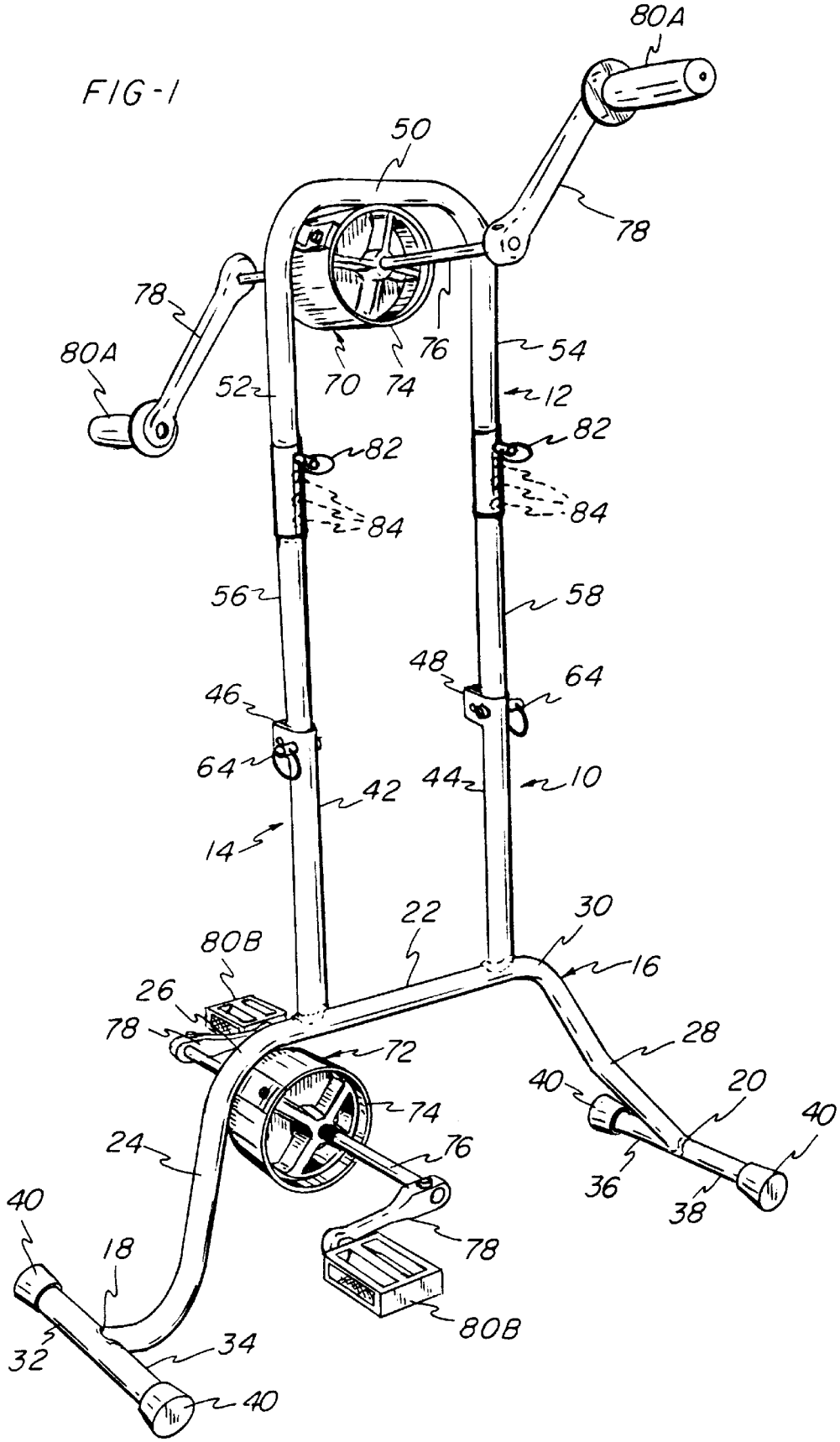
FIG. 1 is a perspective view of the exercise device of the present invention in a use position.

Referring initially to FIG. 1, the present invention comprises an exercise device including a frame 10 which is preferably formed of aluminum tubing or similar lightweight material, and defined by an upper frame portion 12 and a lower frame portion 14. The lower frame portion 14 includes a longitudinally extending central bar 16 having opposing front and rear ends 18 and 20, respectively. The central bar 16 includes a horizontal bar member 22, a first vertical portion 24 extending downwardly from a first end 26 of the horizontal bar member 22 to the front end 18 of the central bar 16, and a second vertical portion 28 extending downwardly from a second end 30 of the horizontal bar member 22 to the rear end 20 of the central bar 16.

The lower frame portion 14 further includes a front leg portion comprising front lateral leg members 32, 34 extending laterally from the front end 18 of the central bar 16 substantially perpendicular to a plane defined by the horizontal bar member 22, first vertical portion 24 and second vertical portion 28 of the central bar 16. Similarly, a rear leg portion for the lower frame portion 14 includes rear lateral leg members 36, 38 extending laterally from the rear end 20 and perpendicular to the plane of the central bar 16. The front and rear lateral leg members 32, 34, 36, 38 define floor engaging members for resisting tipping movement of the exercise device about an axis extending parallel to a line passing through the front and rear ends 18 and 20. In addition, resilient tip members 40 may be provided on the ends of the lateral leg members to facilitate preventing movement of the exercise device along a floor surface during use.

Figure 3A:
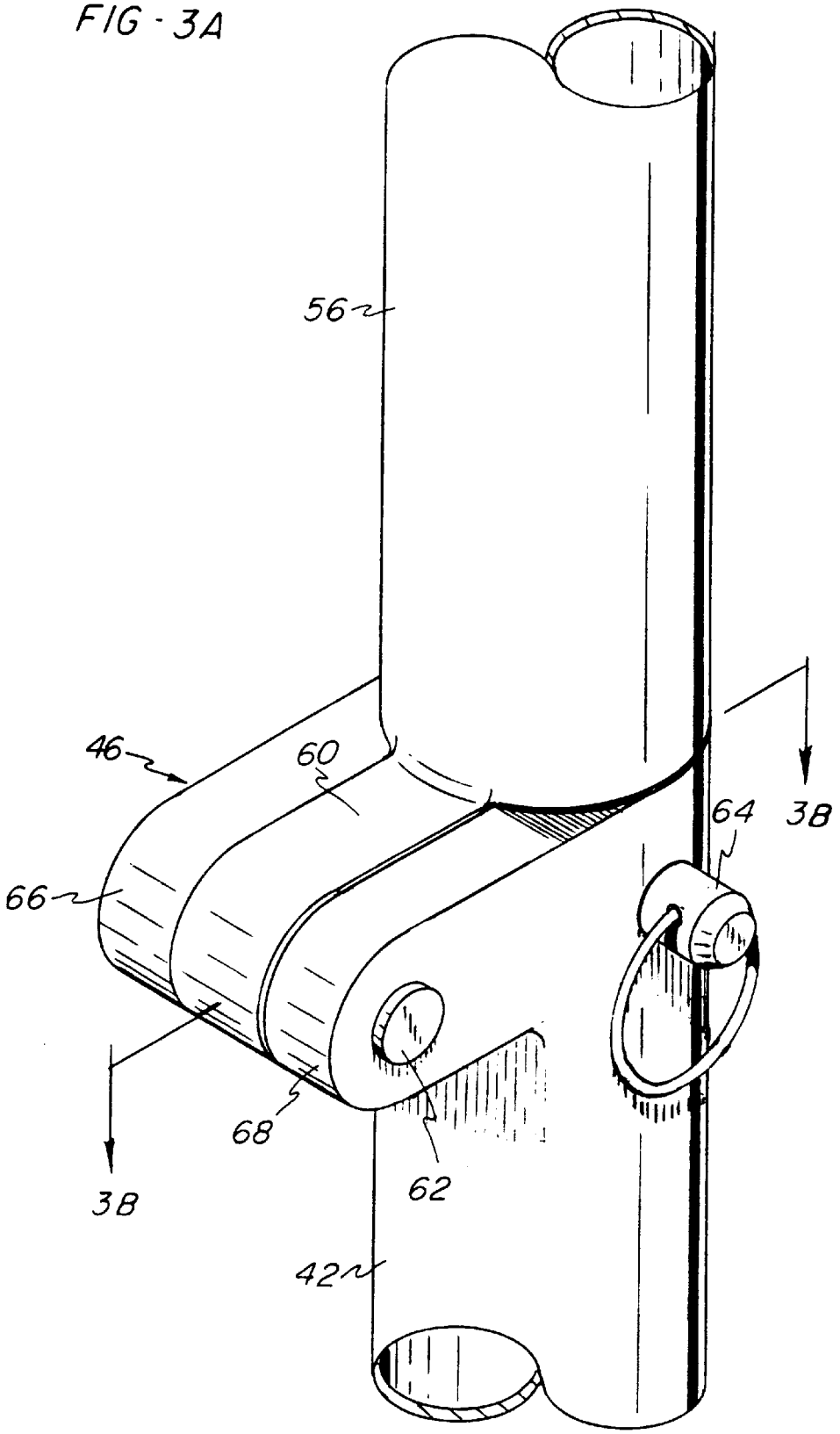
FIG. 3A is a perspective view of a pivot joint for the exercise device.

The lower frame portion 14 also includes front and rear mounting bars 42 and 44 defining a mounting portion and extending upwardly from the horizontal bar member 22. The front mounting bar 42 is located adjacent to the first end 26 and includes a pivot connection 46 at an upper end thereof (see also FIGS. 3A and 3B). The rear mounting bar 44 is located adjacent to the second end 30 and also includes a pivot connection 48 located at an upper end thereof, which pivot connection is identical to the pivot connection 46 of the front mounting bar 42.

The upper frame portion 12 includes a U-shaped bar comprising a horizontal portion 50 and downwardly extending leg portions 52 and 54. The upper frame portion 12 also includes front and rear connecting bars 56 and 58 having ends engaged in telescoping relation with respective downwardly extending leg portions 52 and 54. Each of the front and rear connecting bars 56, 58 includes an integrally formed pivot connection 60 (see FIGS. 3A and 3B) positioned in operative engagement with a respective pivot connection 46, 48 on the front and rear mounting bars 42, 44 to thereby define front and rear pivot joints between the upper frame portion 12 and the lower frame portion 14. The pivot joints are formed by respective pins 62 extending through aligned apertures in the pivot connections of the mounting bars 42, 44 and connecting bars 56, 58, as may be seen in FIGS. 3A and 3B. The connecting bars 56, 58 are held against pivotal movement by means of locking pins 64 which extend through aligned apertures in the mounting bars 42, 44 and connecting bars 56, 58 whereby the upper frame portion 12 is held rigidly in place relative to the lower frame portion 14.

Figure 3B:
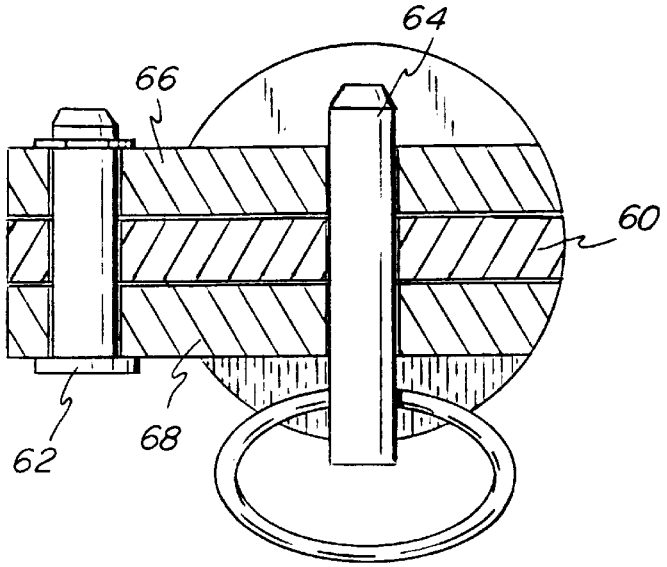
FIG. 3B is a cross-sectional view taken along line 3B—3B in FIG. 3A.

As is best seen in FIG. 3B, and as described with reference to the pivot connection 46, the pivot connection is formed as a clevis structure including spaced ear members 66 and 68. The pivot connection 60 is positioned between the ear members 66, 68 where it is held in position for pivotal movement by the pin 62.

Referring again to FIG. 1, the upper frame portion 12 supports an arm exercise member 70 adjacent to the downwardly extending leg portion 52, and the lower frame portion 14 supports a leg exercise member 72 adjacent to the first vertical portion 24. The arm and leg exercise members 70, 72 are formed as substantially identical units, and each includes a crank housing 74, a horizontal crank shaft 76, crank arms 78 extending from opposing ends of the crank shaft 76 generally perpendicular to the crank shaft 76, and pedal members 80A and 80B extending generally perpendicular from the ends of respective crank arms 78. The pedal members 80A are formed as cylindrical elements designed to be gripped by a user's hands, and the pedal members 80B are designed as planar members adapted to be engaged by a user's feet wherein both the arm exercise member 70 and leg exercise member 72 are independently operable and are rotatable in a conventional manner to exercise a user's arms and legs simultaneously. In addition, each of the arm and leg exercise members 70, 72 is provided with a brake mechanism to selectively provide resistance to rotation, as will be described further below.

The position of the downwardly extending portions 52, 54 relative to the connecting bars 56, 58 may be selectively altered to position the arm exercise member 70 at a desired vertical position relative to the leg exercise member 72. In particular, each of the connecting bars 56, 58 is provided with an aperture for receiving a locking pin 82 therethrough, and each of the downwardly extending portions 52, 54 is provided with a plurality of vertically spaced apertures 84 wherein one of the apertures 84 of each of the downwardly extending portions 52, 54 may be aligned with respective apertures in the connecting bars 56, 58 and held in place by the pins 82 passing through the aligned apertures.

Figure 2:
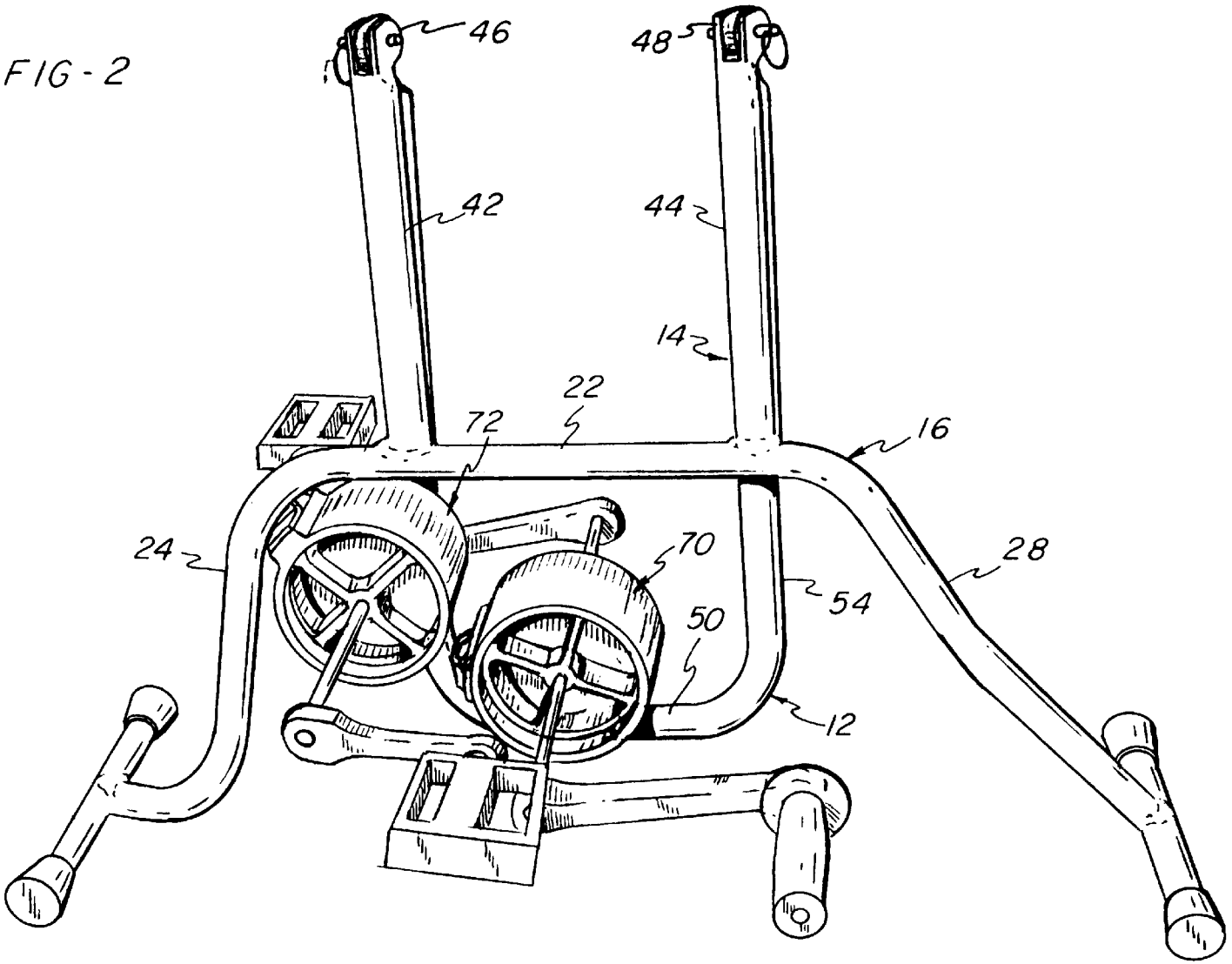
FIG. 2 is a perspective view of the exercise device of the present invention in a storage position.

Referring to FIG. 2, the frame 10 for the exercise device may be reconfigured for convenient transportation and storage of the device. The locking pins 64 at the pivot joints may be removed to permit the upper frame portion 12 to pivot downwardly to a position adjacent to the lower frame portion 14 wherein the upper frame portion 12 defines a plane spaced from and substantially parallel to the plane defined by the central bar 16. It should be noted that the height of the frame 10 in the storage or transportation position shown in FIG. 2 is approximately half the height of the frame 10 in the use position shown in FIG. 1, and the exercise members 70, 72 are located such that they are positioned in nested relation adjacent to each other below the horizontal bar member 22.

Figure 4:
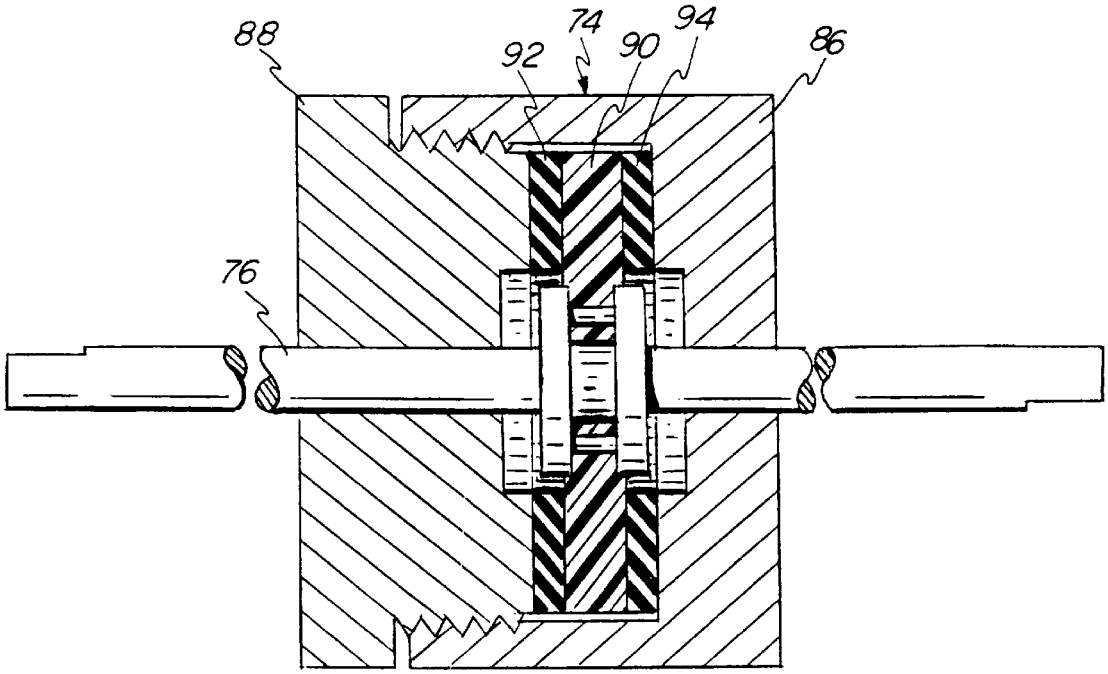
FIG. 4 is a cross-sectional view through one of the exercise members showing a first brake mechanism.

Referring to FIG. 4, a first brake mechanism for use in the exercise members 70, 72 is illustrated including a crank housing 74 defined by a cylinder body 86 and a nut 88 threadably engaged in the cylinder body. A disc 90 is rigidly mounted to the horizontal crank shaft 76 for rotation with the crank shaft 76, and rubber friction members 92, 94 are rigidly mounted to the nut 88 and cylinder body 86, respectively, for frictional engagement with the disc 90. The rubber friction members 92, 94 resist rotational movement of the disc 90, and the degree of rotational resistance may be controlled by rotating the nut 88 relative to the cylinder body 86 to thereby increase or decrease the frictional force on the disc 90. In this manner, the rotational resistance on the crank shaft 76 may be selectively varied, depending on the needs of the user.

Figure 5A:
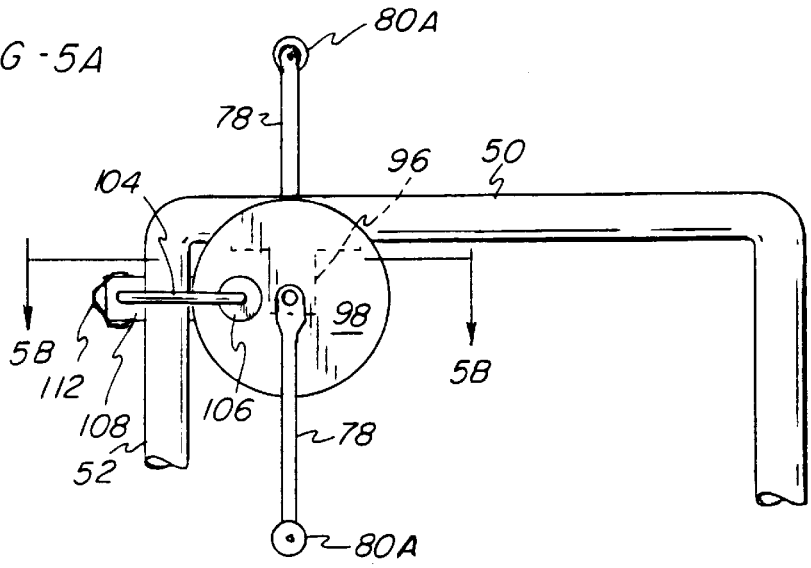
FIG. 5A is a side elevational view of the arm exercise member including a second type of brake mechanism.
Figure 5B:
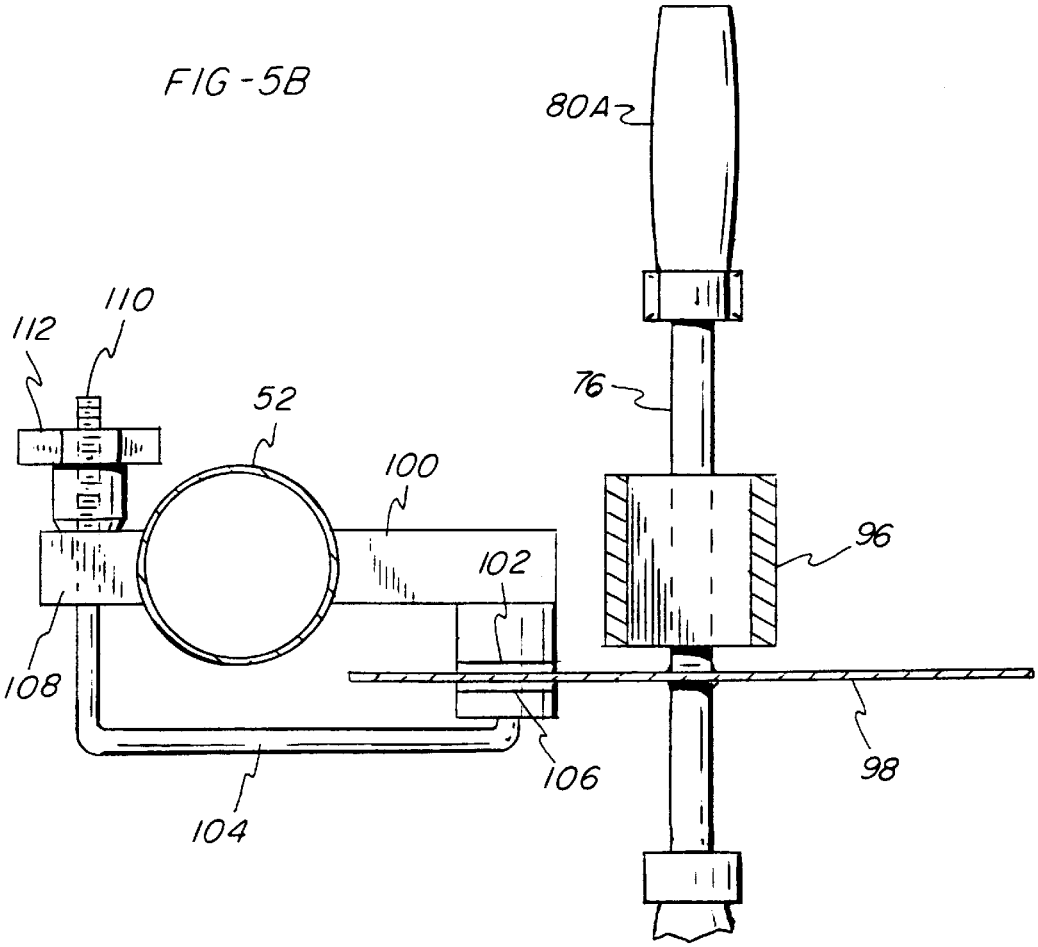
FIG. 5B is a cross-sectional view taken along line 5B—5B in FIG. 5A.

Referring to FIGS. 5A and 5B, a second type of brake mechanism is described with reference to the arm exercise member 70. In this embodiment, the horizontal crank shaft 76 is supported for rotation in a crank housing defined by a bearing member 96. A disc 98 is rigidly supported to the crank shaft 76 at a location adjacent to the bearing member 96. A pad support 100 is supported on the downwardly extending portion 52 and mounts a friction block 102, such as a rubber block, for frictional engagement with a backside of the disc 98. An adjustment bar 104 supports a further friction block 106 for engagement with a front side of the disc 98. The adjustment bar 104 is supported by a block 108 attached to the downwardly extending portion 52 and includes a threaded end 110 threadably engaged with a nut 112. The nut 112 may be rotated to move the adjustment bar 104 to increase or decrease the frictional pressure of the friction blocks 102, 106 on the rotating disc 98. In addition, the portion of the adjustment bar 104 extending through the block 108 may be formed with a square cross-section for cooperating with a hole of corresponding cross-section in the block 108 in order to prevent rotation of the adjustment bar 104 relative to the block 108.

It should be understood that a braking device similar to that described with regard to FIGS. 5A and 5B may be provided for the leg exercise member 72.

From the above description, it should be apparent that the present invention provides an exercise device providing a user with an aerobic workout which may be conveniently performed in a location with limited available space. In use, a user may be seated in a chair with the rear end 20 positioned adjacent to the chair, and the user's feet engaged with the pedals 80B and the user's hands engaged with the pedals 80A to exercise both the legs and arms simultaneously. Further, the device of the present invention provides means for adjusting the height of the arm exercising member in order to accommodate a wide range of users. It should also be noted that the present invention is particularly suitable for use in institutional settings, such as nursing homes, in that the resistance provided by the arm and leg exercising members may be selectively adjusted to accommodate the exercise needs of the user and in that the present device is provided as a lightweight and easily transported device.

In addition, in order to facilitate transportation and storage of the device, a unique folding configuration is provided whereby the frame of the device may be folded to a storage and transportation height which is approximately one-half of its use height, and wherein the frame is folded about an axis extending parallel to a plane of the frame for the device whereby the frame for the device may be folded down upon itself to form a compact easily transported configuration.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An exercise device comprising:

a frame including an upper frame portion and a lower frame portion;

said lower frame portion including floor engaging members for supporting said frame on a floor surface;

an arm exercise member mounted to said upper frame portion for exercising a person's arms, said arm exercise member including a rotatable horizontal crank shaft defining an axis of rotation;

a leg exercise member mounted to said lower frame portion for exercising a person's legs, said leg exercise member including a rotatable horizontal crank shaft defining an axis of rotation;

a pivot connection between said upper frame portion and said lower frame portion whereby said upper frame portion is supported for pivotal movement from a use position where said arm exercise member is located above said pivot connection to a storage position where said arm exercise member is located below said pivot connection; and wherein, in both said use position and said storage position, said axis of rotation of said crank shaft of said arm exercise member is parallel to said axis of rotation of said crank shaft of said leg exercise member, and said pivot connection defines a pivot axis extending perpendicular to said axes of rotation of said crank shafts.

2. The exercise device of claim 1 wherein said pivot connection includes a lock mechanism for locking said upper frame portion in said use position.

3. The exercise device of claim 2 wherein said lock mechanism comprises a pin extending through said upper and lower frame members.

4. The exercise device of claim 1 wherein said floor engaging members comprise front and rear members located at opposing longitudinal locations on said lower frame portion, and including a horizontal bar extending between and connecting said front and rear members, said horizontal bar including a mounting portion supporting said upper frame portion.

5. The exercise device of claim 1 wherein said crank shafts of said arm exercise member and said leg exercise member comprise rotatably supported members mounted for rotation independently of each other.

6. The exercise device of claim 1 wherein each of said leg exercise member and said arm exercise member comprises a crank housing supporting a respective one of said crank shafts for rotatable movement, each said crank shaft including opposing ends and a crank arm extending generally perpendicularly from each of said crank shaft ends, and pedal members extending generally perpendicularly from said crank arms.

7. The exercise device of claim 6 wherein said arm and leg exercise members each include a brake for selectively providing resistance to rotatable movement of said crank shafts.

8. The exercise device of claim 7 wherein said brake comprises a rotating disk mounted for rotation with said crank shaft, stationary friction members for frictionally engaging and resisting rotation of said disk, and a screw mechanism to vary frictional engagement between said friction members and said disk.

9. The exercise device of claim 8 wherein said friction members and said disk are located within said crank housing.

10. The exercise device of claim 1 wherein said pivot axis extends parallel to a plane defined by said lower frame portion.

11. The exercise device of claim 1 including means for selectively positioning said arm exercise member at different vertical positions relative to said leg exercise member.

12. An exercise device comprising:

a frame including an upper frame portion and a lower frame portion;

said lower frame portion including floor engaging members for supporting said frame on a floor surface;

an arm exercise member mounted to said upper frame portion for exercising a person's arms;

a leg exercise member mounted to said lower frame portion for exercising a person's legs;

each of said arm and leg exercise members comprising a crank housing, a horizontal crank shaft extending through and supported by said crank housing for rotatable movement, said crank shaft including opposing ends and a crank arm extending generally perpendicularly from each of said crank shaft ends, and pedal members extending generally perpendicularly from said crank arms;

a pivot connection between said upper frame portion and said lower frame portion whereby said upper frame portion is supported for pivotal movement from a use position where said arm exercise member is located above said pivot connection to a storage position where said arm exercise member is located below said pivot connection; and wherein said upper frame portion comprises a downwardly facing U-shaped member in said use position, and said U-shaped portion is upwardly facing in said storage position.

13. The exercise device of claim 12 wherein the height of said frame in said storage position is approximately half the height of said frame in said use position.

14. The exercise device of claim 12 wherein said lower frame portion comprises a longitudinally extending central bar having opposing front and rear ends, said central bar including a horizontal bar member, a first vertical portion extending downwardly from a first end of said horizontal bar member to said front end of said central bar, and a second vertical portion extending downwardly from a second end of said horizontal bar member to said rear end of said central bar.

15. The exercise device of claim 14 wherein said lower frame portion further includes a front leg portion comprising front lateral leg members extending laterally in opposing directions from said front end substantially perpendicular to a plane defined by said central bar, a rear leg portion comprising rear lateral leg members extending laterally in opposing directions from said rear end substantially perpendicular to said plane defined by said central bar, said front and rear lateral leg members defining floor engaging members for resisting tipping movement of said exercise device about an axis extending parallel to a line passing through said front and rear ends.

16. The exercise device of claim 12 wherein said pivot connection includes a lock mechanism for locking said upper frame portion in said use position.

17. An exercise device comprising:

a frame including an upper frame portion and a lower frame portion;

said lower frame portion including a longitudinally extending central bar having opposing front and rear ends, said central bar including a horizontal bar member, a first vertical portion extending downwardly from a first end of said horizontal bar member to said front end of said central bar, and a second vertical portion extending downwardly from a second end of said horizontal bar member to said rear end of said central bar;

said lower frame portion further including a front leg portion comprising front lateral leg members extending laterally from said front end substantially perpendicular to a plane defined by said central bar, a rear leg portion comprising rear lateral leg members extending laterally from said rear end substantially perpendicular to said plane defined by said central bar, said front and rear lateral leg members defining floor engaging members for resisting tipping movement of said exercise device about an axis extending parallel to a line passing through said front and rear ends;

a mounting portion on said lower frame comprising front and rear mounting bars extending upwardly from said horizontal bar member, said front mounting bar being located adjacent to said first end and including a pivot connection at an upper end thereof, and said rear mounting bar being located adjacent to said second end and including a pivot connection located at an upper end thereof;

said upper frame portion including a U-shaped bar comprising a horizontal portion and downwardly extending leg portions, and front and rear connecting bars having ends cooperating in telescoping relation with said downwardly extending leg portions, each said front and rear connecting bar including a pivot connection positioned in operative engagement with a respective pivot connection on said front and rear mounting bars to thereby define front and rear pivot joints between said upper frame portion and said lower frame portion;

a leg exercise member supported on said lower frame portion adjacent said first end of said horizontal bar member, and an arm exercise member supported on said horizontal portion of said upper frame portion;

each of said leg exercise member and said arm exercise member comprising a crank housing, a horizontal crank shaft extending through and supported by said crank housing for rotatable movement, said crank shaft including opposing ends and a crank arm extending generally perpendicularly from each of said crank shaft ends, and pedal members extending generally perpendicularly from said crank arms; and wherein said upper frame portion is supported for pivotal movement relative to said lower frame portion from a use position where said upper frame extends upwardly in the plane defined by said central bar to a storage position where said upper frame defines a plane adjacent and substantially parallel to said plane defined by said central bar, the height of said frame in said storage position being approximately half the height of said frame in said use position.

18. The exercise device of claim 17 wherein said arm and leg exercise members each include a brake for selectively providing resistance to rotatable movement of said crank shafts.

19. The exercise device of claim 17 including means for selectively positioning said downwardly extending portions of said upper frame portion at one of a plurality of predetermined positions along said front and rear connecting bars to vary the height of said arm exercise member.

* * * * *